United States Patent [19]

Nishimura

[11] Patent Number: 4,759,733

[45] Date of Patent: Jul. 26, 1988

[54] TILTING MECHANISM FOR MARINE PROPULSION

[75] Inventor: Seiichi Nishimura, Hamamatsu, Japan

[73] Assignee: Sanshin Kogyo Kabushiki Kaisha, Hamamatsu, Japan

[21] Appl. No.: 936,340

[22] Filed: Dec. 1, 1986

[30] Foreign Application Priority Data

Nov. 30, 1985 [JP] Japan ..... 60-268388

[51] Int. Cl.[4] ..... B63H 21/26

[52] U.S. Cl. ..... 440/55; 440/63

[58] Field of Search ..... 440/53, 55, 63

[56] References Cited

U.S. PATENT DOCUMENTS

| | | | |
|---|---|---|---|
| 1,389,712 | 9/1921 | Thompson et al. | 440/55 |
| 2,207,372 | 7/1940 | Clarke | 440/55 |
| 3,785,329 | 1/1974 | Shimanckas | 440/55 |
| 3,835,807 | 9/1974 | Kueny | 440/55 |
| 4,099,479 | 7/1978 | Arimitsu | 440/63 |

FOREIGN PATENT DOCUMENTS

| | | | |
|---|---|---|---|
| 139897 | 8/1983 | Japan | 440/63 |

*Primary Examiner*—Joseph F. Peters, Jr.
*Assistant Examiner*—Stephen P. Avila
*Attorney, Agent, or Firm*—Ernest A. Beutler

[57] ABSTRACT

Two embodiments of tilt locking mechanisms including an arrangement for retaining the outboard drive in a tilted up out of the water position and wherein the system is not prone to wear.

10 Claims, 6 Drawing Sheets

TILTING MECHANISM FOR MARINE PROPULSION

BACKGROUND OF THE INVENTION

This invention relates to a tilting mechanism for a marine propulsions and more particularly to an improved tilt lock mechanism for an outboard drive.

Outboard drives, be they outboard motors or the outboard drive section of an inboard/outboard drive generally employ an arrangement for supporting the outboard drive for pivotal movement about a horizontally extending tilt axis. This pvotal movement is provided for two puposes. First, the pivotal movement is employed to adjust the trim position of the outboard drive to suit varied running conditions. In addition, the outboard drive is adapted to be tilted up to an out of the water position for servicing, storage, trailering or the like. It is the conventional practice to employ some form of mechanical locking arrangement to hold the outboard drive in its tilted up position. One such mechanism employs a lever that is pivotally supported on a clamping bracket of the outboard drive and which defines a specially configured slot. A pin is fixed to the outboard drive and rides in this slot during pivotal movement of the outboard drive relative to the clamping bracket. A special configuration at the end of the slot is employed for locking the outboard drive in its tilted up position. Such an arrangement is shown in U.S. Pat. No. 3,785,329, entitled "Combined Reverse Lock And Swivel Bracket Holding Mechanism", issued Jan. 15, 1974 in the name of William J. Shimanckas.

The outboard drive is also permitted to swing about the pivotal axis to pop up under certain running conditions so as to protect the outboard drive from damage. For example, if an underwater obstacle is struck, the outboard drive is permitted to pop up under this condition and then returns to its previous trim position once the underwater obstacle is cleared. In addition, even handling in rough seas may, at times, cause the outboard drive to effect such pivotal movement. With the pin and slot type of arrangements previously employed, however, the repeated pivotal movement tends to wear the slot, particularly in the area where it makes its transition to the locking area and this wear can cause the tilt locking mechanism to be unstable or ineffective.

It is, therefore, a principal object of this invention to provide an improved tilt locking mechanism for an outboard drive.

It is a further object of this invention to provide a tilt locking mechanism for an outboard drive that is simple in operation, is highly effective and which is not prone to wear.

It is a further object of this invention to provide a tilt locking mechanism for an outboard drive that will retain its utility for a long period of time and through repeated usage.

SUMMARY OF THE INVENTION

This invention is adapted to be embodied in a tilt locking mechanism for an outboard drive that comprises a transom bracket that is adapted to be affixed to the transom of an associated watercraft, an outboard drive bracket that is pivotally connected to the transom bracket for tilting movement about a tilt axis from a normal running position to a tilted up storage position and means for controlling the tilting movement and for locking the outboard drive bracket in its tilted up position. This locking means comprises a link that is pivotally supported on one of the brackets and which defines a slot therein. A pin is carried by the other of the brackets and is received in the slot for traversing the slot upon pivotal movement of the outboard drive bracket about the tilt axis and for effecting pivotal movement of the link. Means are provided other than the pin and slot for releasably restraining the link against pivotal movement for retaining the outboard drive bracket in a predetermined angular position about the tilt axis.

DETAILED DESCRIPTION OF THE PREFERRED EMBODIMENTS

Figure 1:
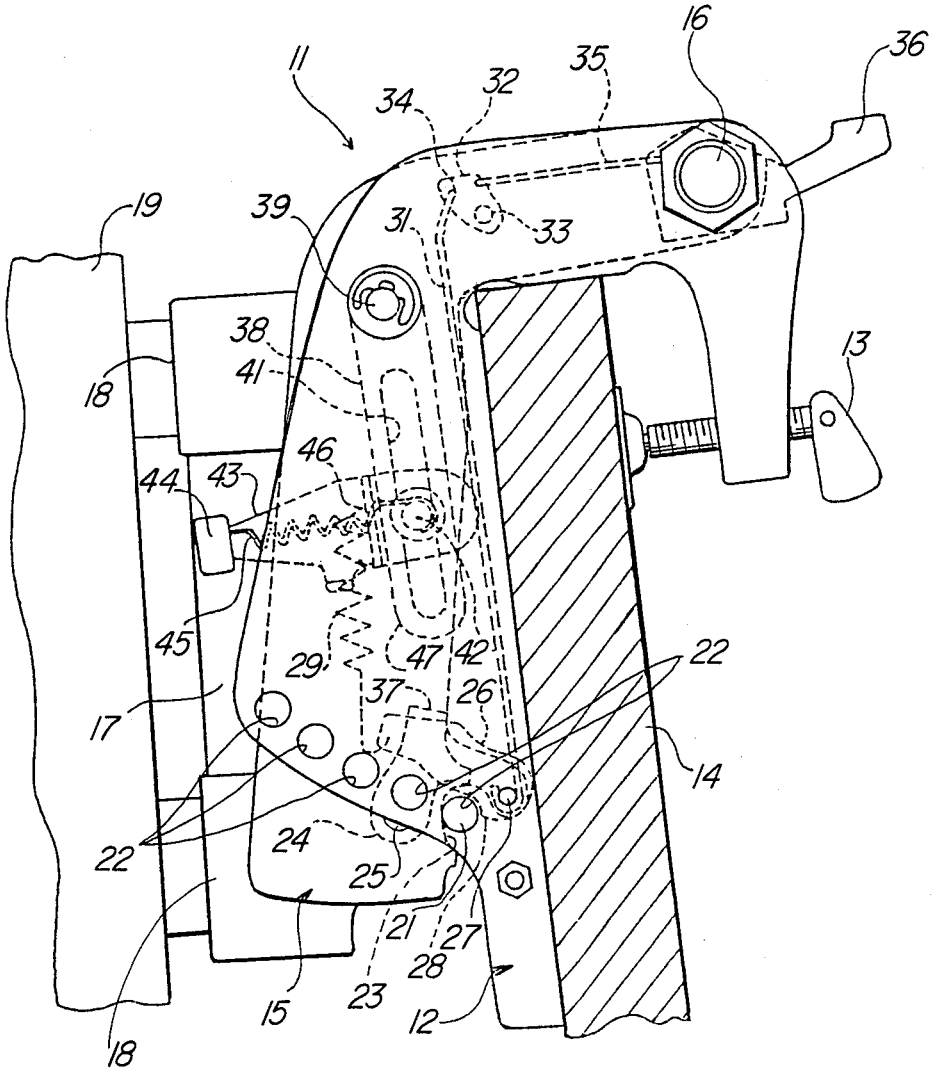
FIG. 1 is a side elevational view of the supporting mechanism for an outboard motor constructed in accordance with an embodiment of the invention and shown in the normal tilted down condition.

Referring first to the embodiment of FIGS. 1 through 5, a portion of an outboard motor constructed in accordance with this embodiment is identified generally by the reference numeral 11. The outboard motor 11 is only partially illustrated since the invention relates to the tilt locking mechanism for it. Therefore, only those components which are associated with the tilt locking mechanism have been illustrated in detail. Also, although the invention is described in conjunction with an outboard motor, it is to be understood that it may equally as well be practiced with the outboard drive unit of an inboard/outboard drive. However, the invention has particularly utility in connection with an outboard motor.

The outboard motor 11 includes a clamping bracket assembly, indicated generally by the reference numeral 12, which carries a clamping device 13 for affixing the outboard motor 11 to a transom 14 of an associated watercraft in a known manner. A swivel bracket assembly 15 is pivotally connected to the clamping bracket 12 by means including a pivot pin 16 for pivotal movement of the swivel bracket 15 and the units carried by it about a horizontally diposed tilt axis for both trim adjustment and to permit the outboard motor to be tilted to an up, out of the water, position.

The swivel bracket 15 includes a bearing portion 17 that journals a steering shaft (not shown) for steering movement about a generally vertically extending steering axis. The steering shaft is, in turn, affixed by means of supporting members 18 to a drive shaft housing 19 of the outboard motor. The drive shaft housing 19 is only shown partially in FIG. 1 and is not shown in the remaining figures. The construction of the outboard motor per se, as aforenoted, forms no part of the invention and is not necessary to understand the invention.

The normal trim position of the outboard motor 11 is adjusted by means of a trim pin 21 that is received in selected ones of pairs of openings 22 formed in the clamping bracket 12. The swivel bracket 15 is provided with a recess 23 that is normally urged into engagement with the trim pin 21 by means of the weight and driving thrust of the outboard motor.

A reverse locking mechanism is carried by the clamping bracket 15 for releasably engaging the trim pin 21 so as to hold the outboard motor against popping up when operating in reverse. This reverse locking mechanism comprises a first lever 24 that is pivotally supported on a pivot pin 25 carried by the swivel bracket 15. The lever 24 has a bellcrank shape and pivotally supports a locking lever 26 by means of a pivot pin 27. The locking lever 26 defines a recess 28 that is adapted to engage the trim pin 21 for holding the outboard motor in its normal running condition. A tension spring 29 is engaged between the end of the lever opposite the pin 27 and the swivel bracket 15 for normally holding the locking lever 26 in its locked position.

A release link 31 is pivotally connected at its lower end to the pivot pin 27 and at its upper end to a lever 32 that is pivotally supported on the swivel bracket 15 by means of a pivot pin 33. The point of pivotal connection between the upper end of the link 31 and the lever 32 is indicated by the reference character 34. A further link 35 is pivotally connected at one of its ends to the link 32 and at its other end to a release lever 36 that is pivotally supported about the tilt pin 16.

When the watercraft is traveling in a forward direction and in the event the lower unit of the outboard motor 11 strikes a submerged underwater obstacle with sufficient force, the outboard motor is permitted to pop up through release of the reverse locking mechanism. Under this condition, the pin 21 will exert a force on the locking lever surface 28 and cause it to pivot upwardly with the lever 24 against the tension of the spring 29. Hence, the swivel bracket 17 can pivot relative to the clamping bracket 12 about the pivot pin 16. Once the underwater obstacle is cleared, the outboard motor 11 will return to its normal position and the reverse locking mechanism will re-engage.

The reverse locking mechanism also may be manually released to permit tilting up of the outboard drive. To accomplish this, the release lever 36 is pivoted in a clockwise direction about the pivot pin 16 to cause the link 35 to urge the lever 32 to rotate in a clockwise direction about the pivot pin 33. This places a tension on the link 31 to draw the lever 26 in an upward direction. When this occurs, the lever 26 will contact a tang 37 formed on the lever 24 and effect its pivotal movement against the action of the spring 29 so as to release the mechanism.

The pivotal movement of the swivel bracket 17 relative to the clamping bracket 12 is controlled by a mechanism now to be described, which mechanism further provides a locking arrangement for locking the outboard motor in its tilted up, out of the water condition. This mechanism includes a link 38 that is pivotally supported on the clamping bracket 12 by means of a pivot pin 39. The link 38 has a straight slot 41 formed in it.

A pin 42 is affixed to the swivel bracket 16 and is slidably received in the slot 41. Hence, as the outboard drive and specifically the swivel bracket 17 is pivoted relative to the clamping bracket 12, the link 38 will be caused to rotate about the pivot pin 39 because of the action of the pin 42 in the slot 41 as clearly seen in FIGS. 2 and 3.

Figure 2:
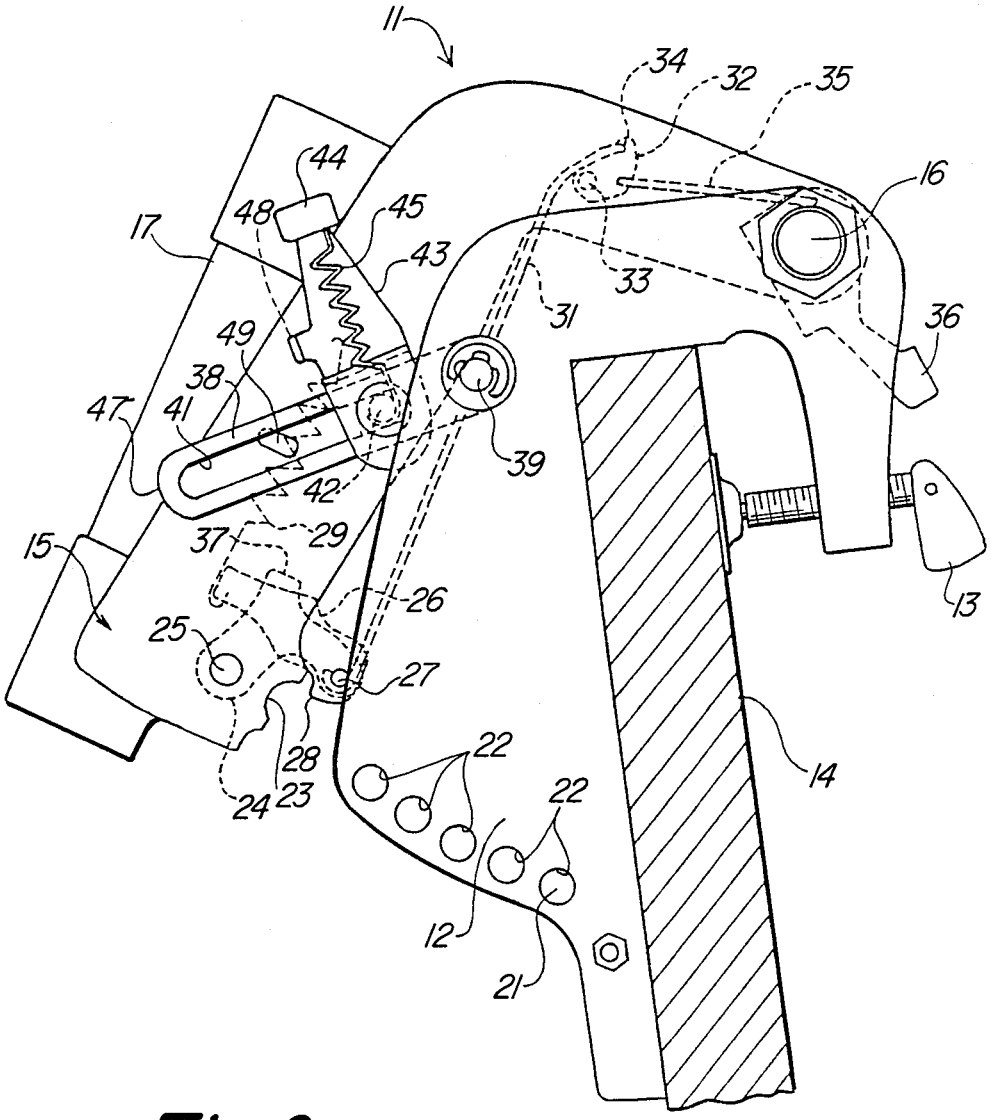
FIG. 2 is a side elevational view, in part similar to FIG. 1, showing the initial tilting up movement of the outboard drive.
Figure 3:
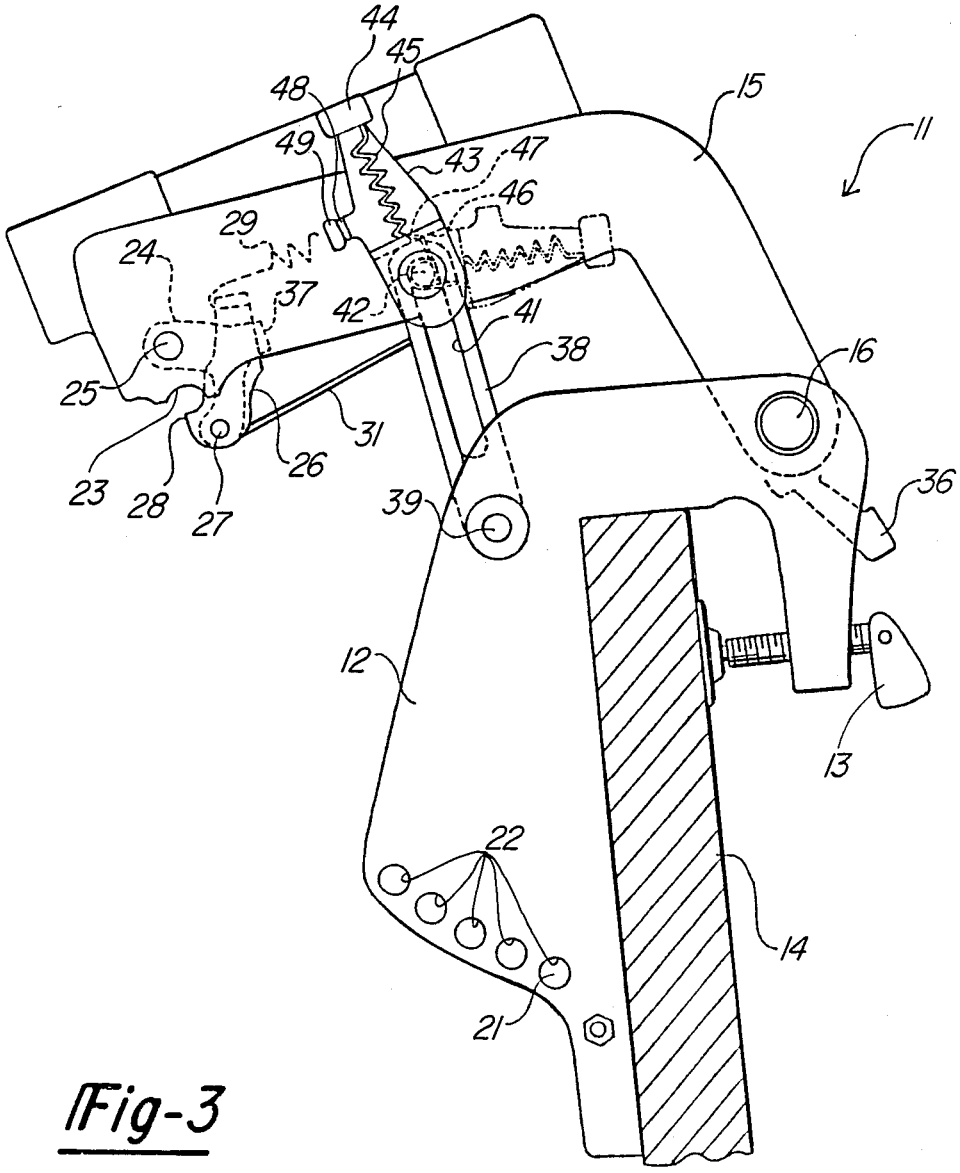
FIG. 3 is a side elevational view, in part similar to FIGS. 1 and 2, showing the outboard drive unit pivoted to and locked in its tilted up position.

A mechanism is provided for locking the link 38 in the position corresponding to the fully tilted up position (FIG. 3) for retaining the swivel bracket 17 and supported outboard motor in the tilted up out of the water condition. This locking mechanism includes a locking lever 43 that is pivotally supported on the swivel bracket 15 by means such as by the pin 42. The lever 43 has an operating knob 44 on its outer end which permits a user to grasp it and rotate it between the released position as shown in FIGS. 1 and 2 and an engaged position as shown in FIG. 3. A tension spring 45 is connected between the lever 43 and the pivot pin 42 for holding the lever 43 in either of its locked or released positions by means of an over center type of relationship. The locking lever 43 has a locking surface 46 that is adapted to engage an end 47 of the link 38 for holding it in its tilted up out of the water position.

Figure 4:
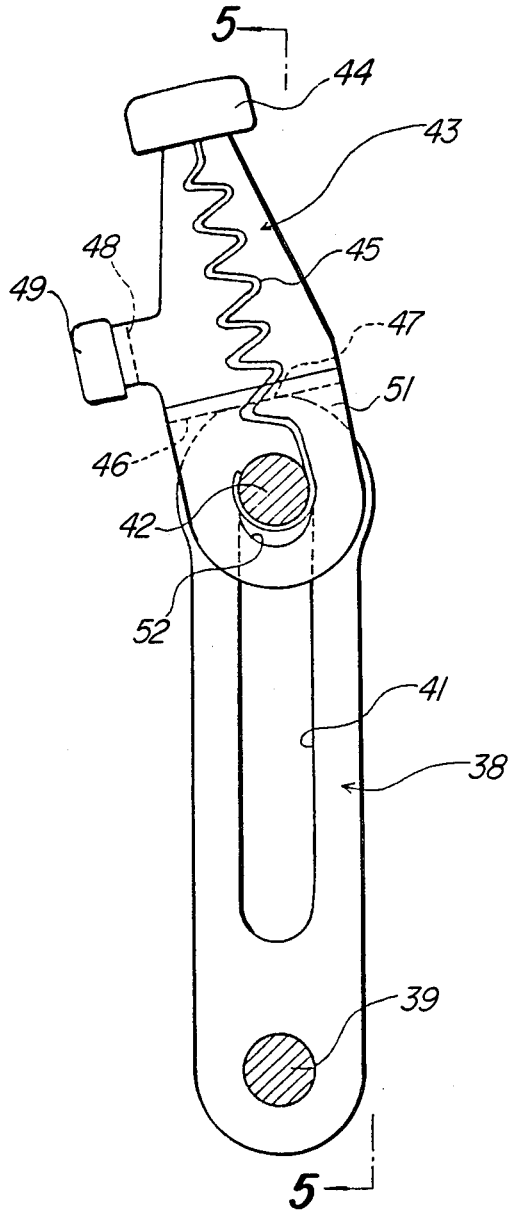
FIG. 4 is an enlarged side elevational view of the tilt locking mechanism in the condition shown in FIG. 3.

In order to tilt the outboard motor from its normal running condition as shown in FIG. 1 to the tilted up out of the water condition, the reverse locking mechanism is released by pressing the operating lever 36 downwardly in the manner as aforedescribed. The motor then may be raised and tilted so that the swivel bracket 15 tilts about the pivot pin 16 from the position shown in FIG. 1 to an intermediate position as shown in FIG. 2. As the motion continues, the tilt locking lever 43 is rotated from its released position until a tang 48 engages a fixed stop 49 on the swivel bracket 15 (FIGS. 3 and 4). The spring 45 will tend to hold the lever 43 in this position.

Figure 5:
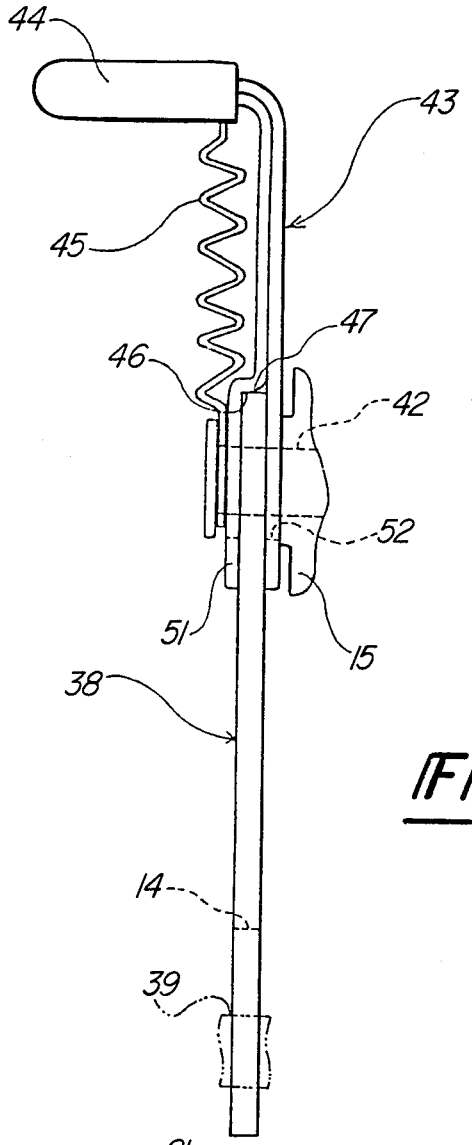
FIG. 5 is a side elevational view taken generally along the line 5—5 of FIG. 4.

As the outboard motor is continued to be raised to its fully tilted up position, the link 38 will swing upwardly so that its end 47 engages the locking lever undersurface 46. The lever 43 is permitted to slide upwardly relatively to the pin 42 during this operation since an extending portion 51 of the lever 43 is provided with an elongated slot 52 so as to permit such movement against the action of the spring 45. However, when the outboard motor is fully tilted up, the spring 45 will again urge the surface 46 into engagement with the link surface 47 so as to releasably restrain the outboard motor in its tilted up position as shown in FIG. 3 through 5. In order to release the outboard motor, the lever 43 is rotated away from the stop 49 and the motor then may be returned to its normal running condition in a manner which is believed to be apparent to those skilled in the art.

Figure 6:
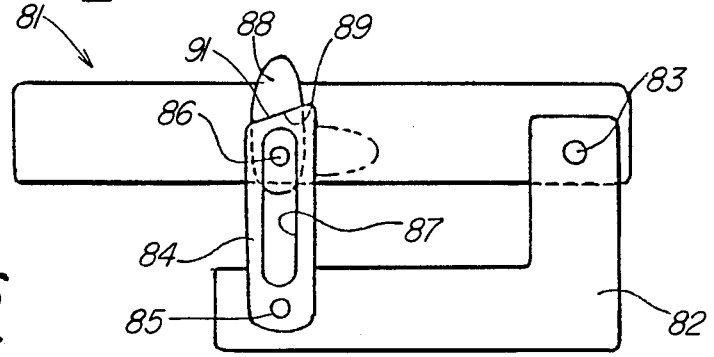
FIG. 6 is a partially schematic view showing another embodiment of the invention.

In the embodiment thus far described, the tilt locking link 38 was pivotally supported on the clamping bracket 12 and the locking handle and pin was supported on the swivel bracket 15. It should be readily apparent to those skilled in the art that the mounting of these elements may easily be reversed and FIG. 6 shows such an embodiment with certain additional changes. In this embodiment, the clamping bracket and swivel bracket are depicted schematically and are identified generally by the reference numerals 81 and 82, respectively. The swivel bracket 82 is pivotally supported on the clamping bracket 81 by means of a tilt pin 83. In this embodiment, the tilt locking lever 84 is pivotally supported on the swivel bracket 92 by means of a pivot pin 85. A pin 86 is carried by the clamping bracket 81 and is received in a slot 87 of the tilt locking lever 84. As with the previously described embodiment, the slot 87 is generally linear. Pivoted movement of the swivel bracket 82 relative to the clamping bracket 81 will effect pivotal movement of the tilt locking lever 84 as should be readily apparent.

A locking lever 88 is pivotally supported upon the pivot pin 86 on the clamping bracket 81 and has a lower locking surface 89 that is adapted to engage a corresponding inclined locking surface 91 of the tilt locking lever 84 for holding it in the tilted up position.

It should be readily apparent that the foregoing description is that of two embodiments of the invention and that various changes and modifications may be made without departing from the spirit and scope of the invention, as defined by the appended claims.

What is claimed is:

1. A tilt locking mechanism for an outboard drive comprising a transom bracket adapted to be affixed to the transom of an associated watercraft, an outboard drive bracket pivotally connected to said transom bracket for tilting movement about a tilt axis from a normal running position to a tilted up storage position, and means for controlling said tilting movement and for locking said outboard drive bracket in said tilted up position comprising a link pivotally supported on one of said brackets and defining a slot therein, a pin carried by the other of said brackets and received in said slot for traversing said slot upon pivotal movement of said outboard drive bracket about said tilt axis for effecting pivotal movement of said link, and releasably restraining means other than said pin and said slot for releasably retaining said link against pivotal movement when said outboard drive bracket is in a tilted up position for retaining said outboard drive bracket in said tilted up position about said tilt axis.

2. A tilt locking mechanism as set forth in claim 1 wherein the releasable restraining means is effective to hold the outboard drive bracket in its tilted up position.

3. A tilt locking mechanism for an outboard drive comprising a transom bracket adapted to be affixed to the transom of an associated watercraft, an outboard drive bracket pivotally connected to said transom bracket for tilting movement about a tilt axis from a normal running position to a tilted up storage position, and means for controlling said tilting movement and for locking said outboard drive bracket in said tilted up position comprising a link pivotally supported by one of said brackets and defining a slot therein, said slot being a linear slot throughout its entire operative length, a pin carried by the other of said brackets and received in said slot for traversing said slot upon pivotal movement of said outboard drive bracket about said tilt axis for effecting pivotal movement of said link, and releasable restraining means other than said pin and said slot for releasably retaining said link against pivotal movement for retaining said outboard drive bracket in a predetermined angular position about said tilt axis.

4. A tilt locking mechanism as set forth in claim 1 wherein the releasable restraining means comprises a latch operative directly with the link.

5. A tilt locking mechanism as set forth in claim 4 wherein the latch is engageable with one end of the link.

6. A tilt locking mechanism as set forth in claim 5 wherein the slot is a linear slot throughout its entire operative length.

7. A tilt locking mechanism as set forth in claim 4 wherein the latch is pivotally supported by the other of the brackets.

8. A tilt locking mechanism as set forth in claim 7 wherein the latch is pivotally supported by the pin.

9. A tilt locking mechanism as set forth in claim 6 wherein the latch is pivotally supported by the other of the brackets.

10. A tilt locking mechanism as set forth in claim 9 wherein the latch is pivotally supported by the pin.

* * * * *